United States Patent [19]

Whitaker, Jr.

[11] Patent Number: 4,850,123

[45] Date of Patent: Jul. 25, 1989

[54] BALLAST REMOVAL APPARATUS

[75] Inventor: John B. Whitaker, Jr., Wetumpka, Ala.

[73] Assignee: Kershaw Manufacturing Co., Inc., Montgomery, Ala.

[21] Appl. No.: 237,716

[22] Filed: Aug. 29, 1988

[51] Int. Cl.[4] ..... E02F 5/22

[52] U.S. Cl. ..... 37/104; 171/16

[58] Field of Search ..... 37/104–107, 37/110, 112, 113, 114; 71/16; 299/79, 82, 83, 84, 34, 41, 65, 66, 73, 76

[56] References Cited

U.S. PATENT DOCUMENTS

| | | | |
|---|---|---|---|
| 1,625,864 | 4/1927 | Melin | 171/16 |
| 1,778,690 | 10/1930 | Scheuchzer | 171/16 |
| 2,886,904 | 5/1959 | Kershaw | 37/104 |
| 3,096,829 | 7/1963 | Plasser et al. | 171/16 |
| 3,356,157 | 12/1967 | Plasser et al. | 171/16 |
| 3,436,848 | 4/1969 | Peppin et al. | 37/104 |
| 3,457,660 | 7/1969 | Speno | 171/16 |
| 3,553,859 | 1/1971 | McIlrath | 37/104 |
| 3,706,145 | 12/1972 | Bucksch et al. | 37/105 |
| 3,967,395 | 7/1976 | Stewart | 37/104 |
| 3,967,396 | 7/1976 | Maisonneuve et al. | 37/104 |
| 4,563,826 | 1/1986 | Whitaker, Jr. | 37/104 |
| 4,674,208 | 6/1987 | Whitaker, Jr. | 37/104 |
| 4,705,115 | 11/1987 | Whitaker, Jr. | 171/16 |
| 4,706,395 | 11/1987 | Cicin-Sain | 37/105 |

FOREIGN PATENT DOCUMENTS

| | | | |
|---|---|---|---|
| 484521 | 7/1952 | Switzerland | 37/104 |
| 2063971 | 6/1981 | United Kingdom | 171/16 |
| 2172326 | 9/1986 | United Kingdom | 171/16 |

*Primary Examiner*—Eugene H. Eickholt

*Attorney, Agent, or Firm*—Jennings, Carter, Thompson & Veal

[57] ABSTRACT

An apparatus for removing ballast utilizes eccentrically mounted disk-like undercutters to remove ballast from a position adjacent the track shoulder inwardly to a position underneath the ends of the crossties. The undercutters project inwardly from their mounting position on the lower ends of vertically disposed columns which overhang each side of a supporting carriage. The vertically disposed columns attach to horizontal sliders mounted transversely relative to the carriage. Linear actuators act to position the undercutters for ballast removal.

23 Claims, 4 Drawing Sheets

FIG. 2
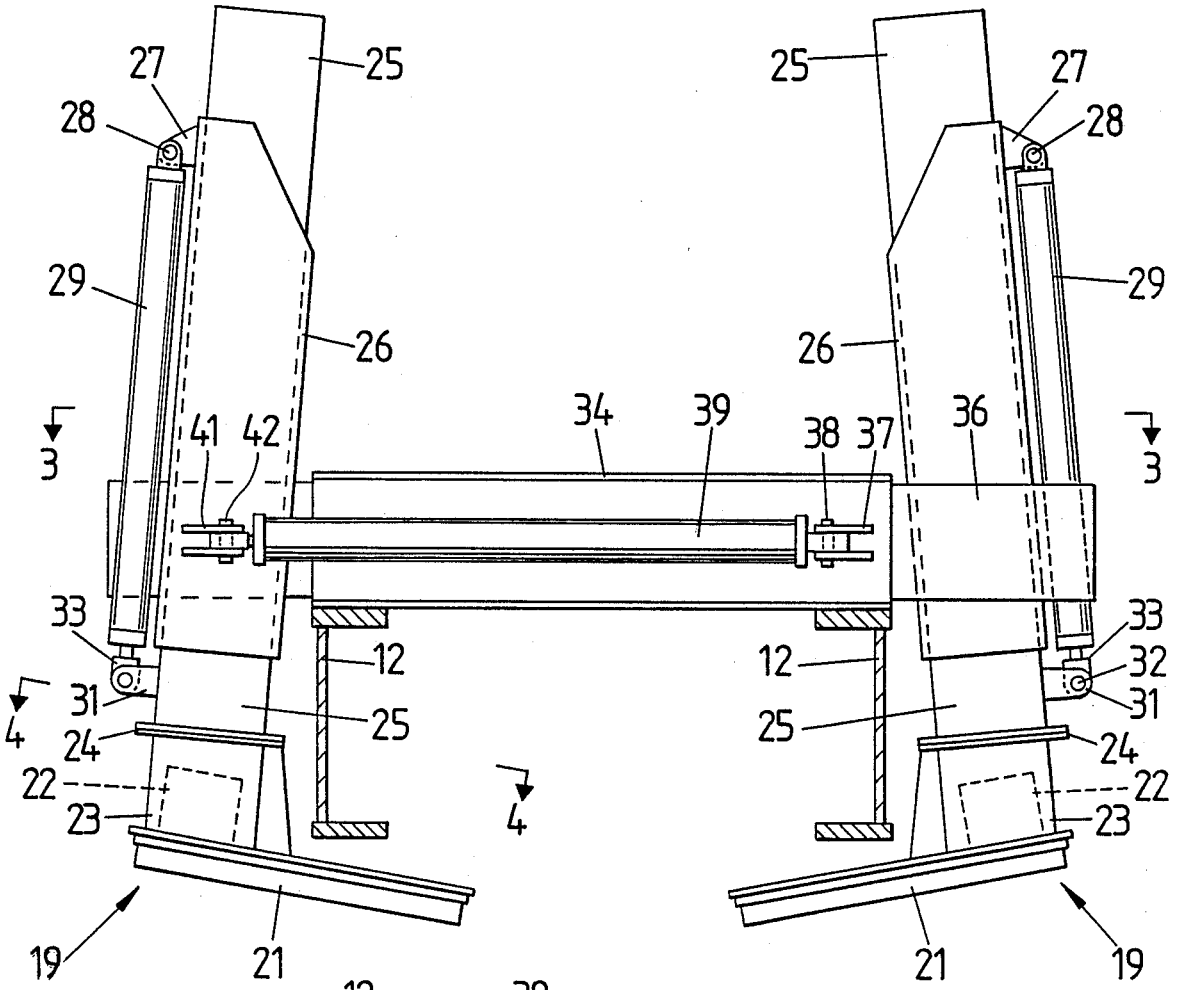
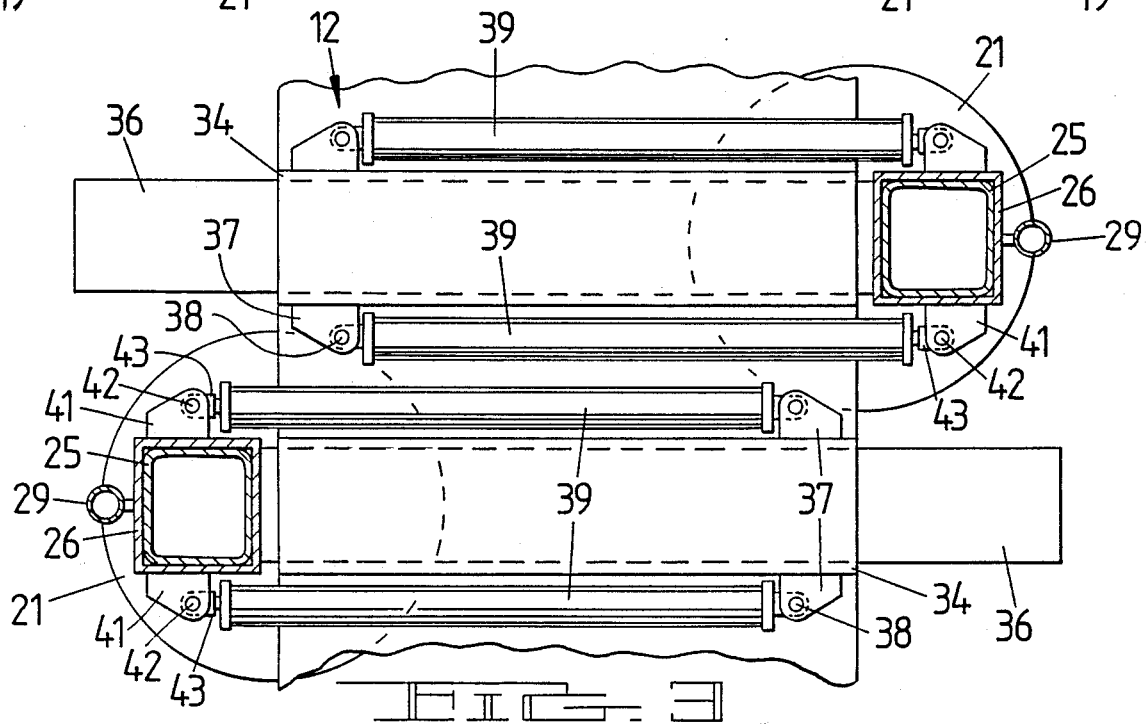
FIG. 3

BALLAST REMOVAL APPARATUS

FIELD OF THE INVENTION

The present invention relates to the field of railroad maintenance equipment. More particularly, the present invention relates to apparatus for the removal of ballast from alongside the shoulder of railroad tracks.

Numerous devices have been devised to remove fouled ballast from beneath existing railroad tracks. Pertinent examples are disclosed in U.S. Pat. Nos. 1,625,846; 1,778,690; 2,886,904; 3,096,829; 3,356,157; 3,967,396; 4,563,826; 4,674,208; and 4,705,115. In each of the above examples an undercutter, either pivotal or fixed, is utilized to remove ballast from underneath the tracks to a position on the periphery of the roadbed. After deposition the ballast is picked up by a trailing elevator means or is transported on a conveyor to a leading elevator means for removal. Only one of the known prior art devices, disclosed in U.S. Pat. No. 2,886,904, incoporates means for removal of fouled ballast from along the shoulder of the track proximal the tie ends. The disk-like cutters on that apparatus removed ballast from the track shoulders to partially clear a path for the trailing elliptical undercutter. The increased capacity of the dual cutter system allowed the apparatus to process ballast at a higher rate without fouling or clogging. The limited range of motion in the disclosed structures supporting the circular cutters greatly reduces their ballast removal capabilities. The design was not totally satisfactory in terms of efficiency, simplicity, ease of positioning, and operable cutting range.

SUMMARY OF THE INVENTION

It is the object of the present invention to provide an apparatus for removing ballast from along the shoulder of a railroad track outwardly of the track rails. It is a further object of the present invention to provide an apparatus for such shoulder ballast removal which may easily be positioned beneath the track and which utilizes minimal physical space when incorporated into the carriage of a mobile track maintenace vehicle.

To accomplish this object I have provided an undercutter which may be used alone or as a component part of a complete ballast cleaning and track maintenance system. The apparatus utilizes disk-like rotary digging units positioned on the lower end of vertically disposed columns. Unlike conventional rotary units the cutting disks are eccentrically mounted to the vertical columns to more effectively reach areas beneath the railroad tie ends. The cutting disks are also angled below the horizontal plane to achieve greater ballast removal depth. The vertical columns, positioned on each side of the track maintenance vehicle, are supported in vertically disposed slider boxes. Unlike traditional devices, the slider boxes are not positioned vertically relative to the maintenance vehicle, but are offset from the vertical plane inwardly toward the vehicle centerline to more effectively position the cutting disks for ballast removal. Thus use of the term vertical herein may be taken in include associated devices which are generally vertical in position.

Each cutting disk may be moved from a non-working position above the track to a working position adjacent the track shoulder by actuation of vertical hydraulic cylinders. The hydraulic cylinders are the sole connective means linking the vertical columns and vertical slider boxes. Thus, no intermediate linkage system limits the vertical working range of the apparatus.

The above mentioned vertical slider boxes are rigidly affixed to horizontal sliders which travel within horizontally disposed slider boxes atop the track maintenace vehicle. Horizontal hydraulic cylinders attached to the horizontal slider boxes act directly on the vertical slider boxes, the vertical slider boxes and horizontal sliders thereby moving inwardly and outwardly. Thus, the cutting disks must likewise move inwardly and outwardly. No complex linkage limits the horizontal working range of the apparatus.

It will be appreciated that the above described mechanism allows the operator virtually unlimited freedom in positioning the cutting disks beneath the tie ends. The simplicity of the mechanism reduces maintenance and lowers manufacturing costs. Most importantly, the increased cutting disk positioning flexibility offered by the mechanism disclosed herein allows the track maintenance vehicle to process a greater ballast volume per unit operating hour. If an operator wishes to remove shoulder ballast only, the present invention will perform the operation capably. The apparatus may also be utilized to remove shoulder ballast immediately ahead of a chain undercutter unit to ease forward progess and prevent undercutter clogging under extremely fouled ballast conditions. If the track maintenance vehicle utilizes a conventional upright ditcher wheel to excavate a trench alongside the ties, the present invention may also operate following the ditcher wheel to transfer ballast from underneath the ties into the freshly excavated trench.

BRIEF DESCRIPTION OF THE DRAWINGS

Apparatus embodying features of my invention are depicted in the accompanying drawings, which form a portion of this application, and wherein:

FIG. 2 is a elevational view of my invention on a carriage shown partially in section;

FIG. 3 is a plan view partially in section of my invention along line 3—3 of FIG. 2;

DESCRIPTION OF A PREFERRED EMBODIMENT

Figure 1:
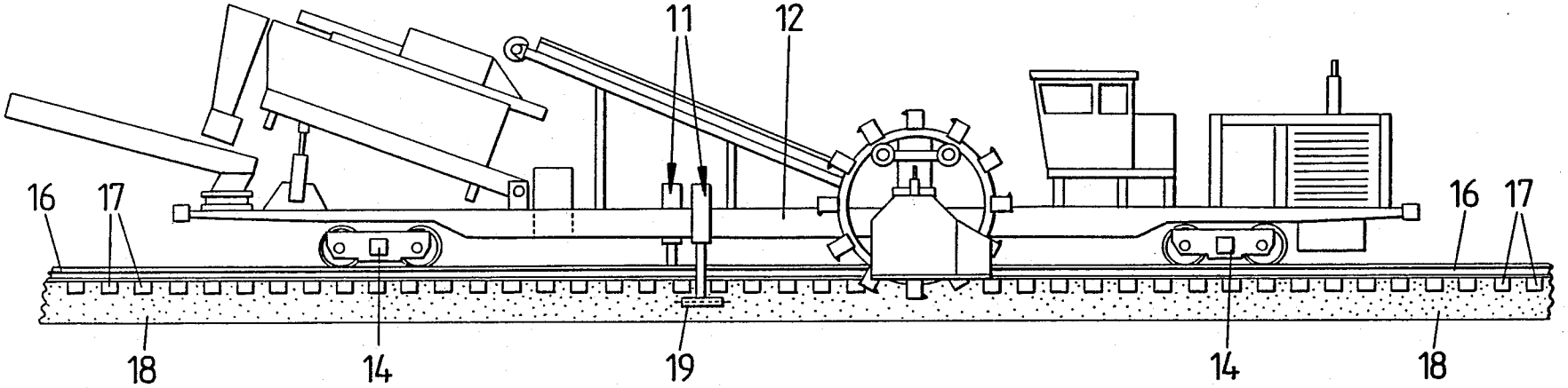
FIG. 1 is a side elevational view showing my invention attached onto the carriage of a mobile ballast reconditioning vehicle.

Referring to FIG. 1, my invention is a form of ballast removing apparatus 11 functioning as an integral part of a mobile ballast reconditioning vehicle. The apparatus 11 generally comprises a pair of rotary undercutter assemblies 19 disposed on opposite sides of a carriage frame 12. Frame 12 is supported by wheel assemblies 14 adapted for travel on rails 16. As is well known, the rails 16 lie atop crossties 17, which are underlain by a ballast bed 18.

Referring to FIG. 2, each undercutter assembly 19 features a disk-like circular undercutter 21 powered by a hydraulic motor 22 within motor housing 23. The hydraulic motor 22 is operatively connected to a source of high pressure hydraulic fluid (not shown) as is well known in the art. Motor housing 23 is affixed by a flange 24 to a vertical column or slider 25, which moves within a vertical slider box 26. An ear 27 is affixed to the upper end of the vertical slider box 26 and is oriented perpendicular to the outside face thereof. A bolt 28 passes through an aperture in the ear 27 and engages the upper end of a vertically disposed hydraulic cylinder 29. Similarly, an ear 31 is perpendicularly affixed to the outside face of the lower end of vertical column 25. A bolt 32 passes through apertures in the ear 31 and a lug 33 to engage the lower end of the vertically disposed hydraulic cylinder 29. Actuation of the hydraulic cylinders 29 raises the undercutter assemblies 19 to a non-working travel position (FIG. 6) or lowers them to a working position proximal the ends of the crossties of the railroad track (FIG. 7).

Referring to FIG. 3, the horizontal slider boxes 34 are rigidly affixed transversly of frame 12. Horizontal sliders 36 travel within horizontal slider boxes 34 and attach on one end to vertical slider boxes 26. Note that ends of horizontal sliders 36 opposite the aforementioned attachment to vertical slider boxes 26 extend beyond frame 12 to increase stability upon extreme extension. A pair of ears 37 extend laterally from opposite faces of horizontal slider boxes 34. A pair of bolts 38 extend through apertures in the ears 37 and engage one end of horizontal hydraulic cylinders 39. Additional ears 41 extend laterally from opposite faces of vertical slider boxes 26. Bolts 42 pass through apertures in ears 41 and lugs 43 to engage the other ends of the horizontal hydraulic cylinders 39. Thus, actuation of the hydraulic cylinders 39 moves the undercutter assemblies 19 outwardly from a non-working (travel) position adjacent the carriage 12 (FIG. 6) to a working position proximal the ends of the crossties of the railroad track (FIG. 7).

Figure 4:
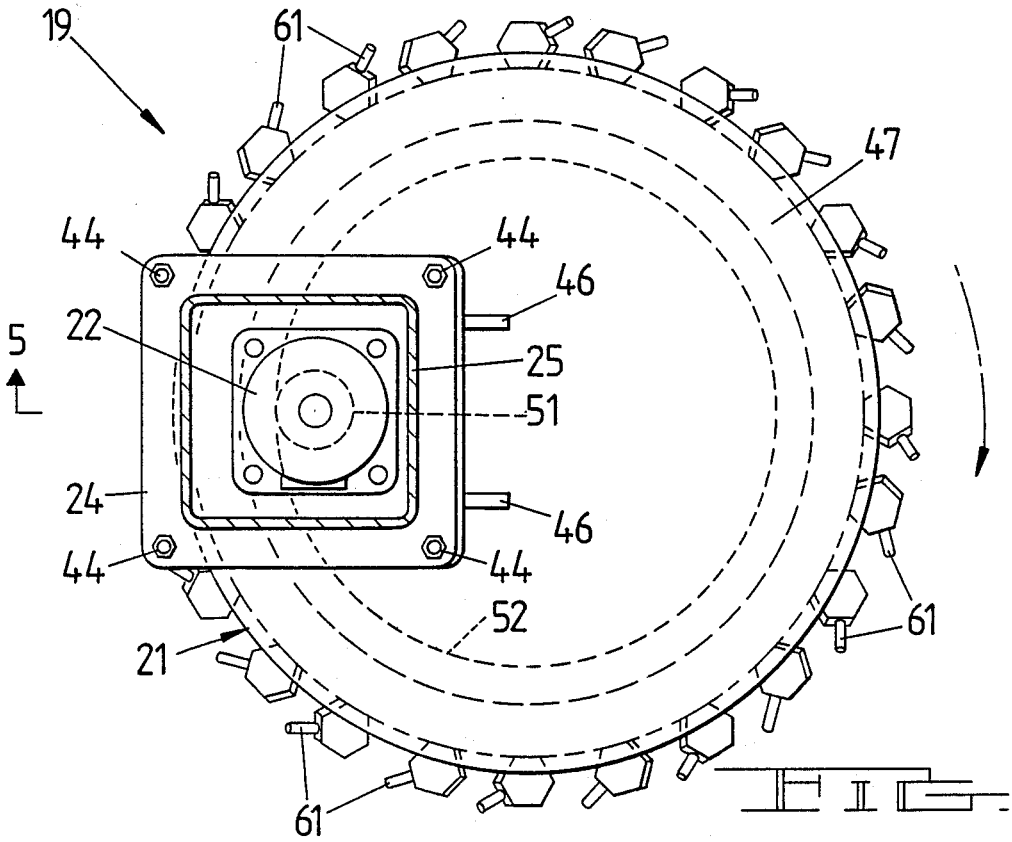
FIG. 4 is a sectional view of my invention taken along line 4—4 of FIG. 2.
Figure 5:
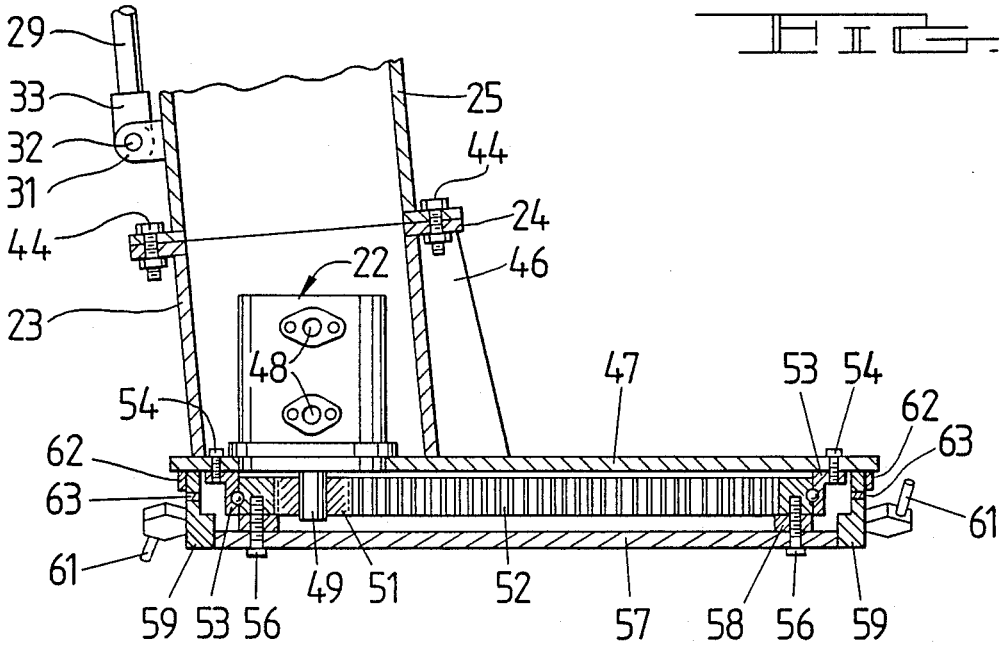
FIG. 5 is a sectional view of a cutting disk taken along line 5—5 of FIG. 4.

The rotary undercutter assemblies 19 are more clearly depicted in FIGS. 4 and 5. Referring to FIG. 5, note the plane of rotation of circular undercutter 21 is disposed below a plane normal to vertical slider column 25. Such orientation allows circular undercutters 21 greater access to ballast below the ends of the crossties 17 (see FIG. 7). Bolts 44 inserted in the flange 24 attach the motor housing 23 to vertical slider column 25. A gussett 46 is affixed to an upper plate 47 and protects the motor housing 23 from impact damage upon contact with the ends of crossties 17. The upper plate 47 is affixed to the lower end of the motor housing 23 and supports the hydraulic motor 22. High pressure hydraulic fluid enters and exits the hydraulic motor 22 via lines attached to ports 48. Passage of hydraulic fluid through the hydraulic motor 22 turns a vertical shaft 49 which protrudes through the upper plate 47. Rotation of the vertical shaft 49 turns a pinion gear 51, which engages the inner toothed surface of an annular drive gear 52. The drive gear 52 turns on an annular bearing 53, which is suspended from the upper plate 47 by bolts 54. Bolts 56 pass through a lower plate 57 and a spacer ring 58 to engage the annular drive gear 52. An annular cutter bit support ring 59 is affixed to and rotates concomitantly with the lower plate 57. A plurality of cutter bits 61 screw into threaded receptacles in the annular cutter bit support ring 59. Note that the cutter bits 61 are alternately directed above and below the plane of rotation of the circular undercutters 21 to increase the ballast processing rate. An annular ring plate 62 and a flush plug 63, in combination with the lower plate 57, prevent entry of foreign objects into the undercutter drive mechanism.

Referring to FIG. 4, note the eccentric mounting of the circular undercutter 21 on the vertical slider column 25, which allows greater access to the area beneath the tie ends. The hydraulic motor 22 is mounted on the upper plate 47 by bolts 64. The pinion 51 engages the annular drive gear 52, which turns the annular cutter bit support ring 59. A plurality of cutter bits 61 mount on the periphery of the annular cutter bit support ring 59 and are alternately directed upward and downward as noted above. Clockwise motion of the circular undercutter 21 displaces fouled ballast and directs the dislodged material along the track shoulder.

Figure 6:
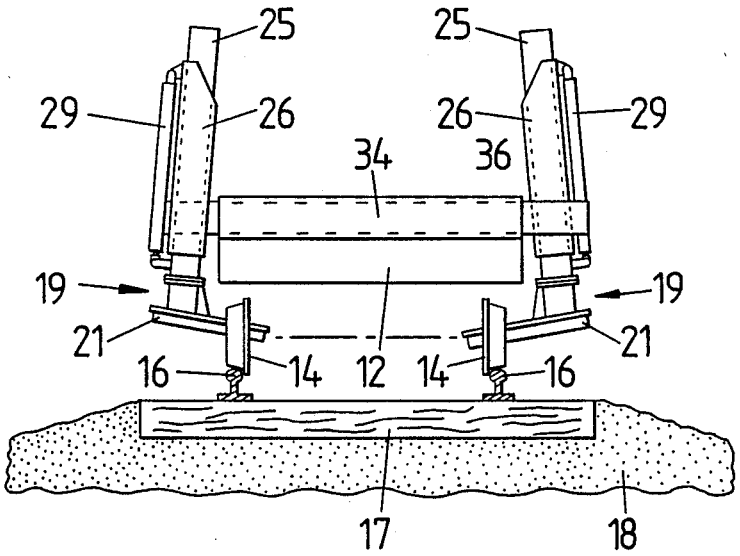
FIG. 6 is a track level elevational view showing my invention in a non-working (travel) position.
Figure 7:
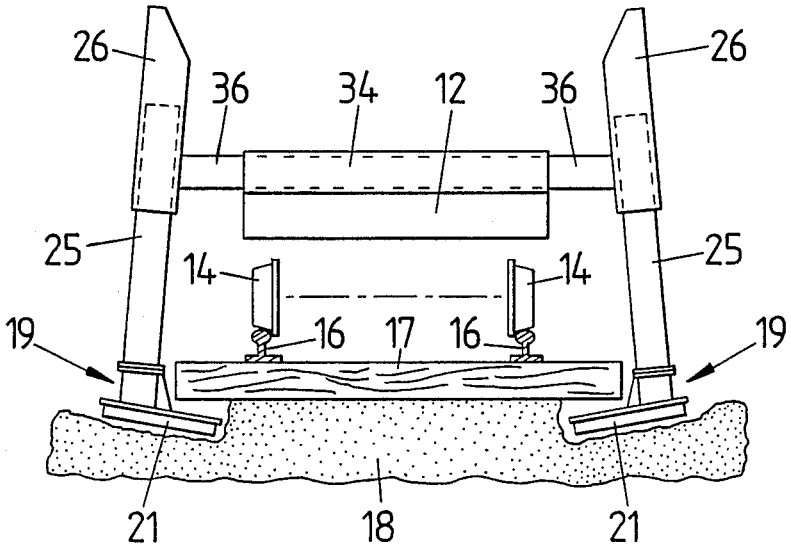
FIG. 7 is a track level elevational view showing my invention in a working position with the cutting disks beneath the crosstie ends.

FIG. 6 shows the apparatus in a travel position for transportation to the work site. In operation, the hydraulic cylinders 29 and 39 are activated to position the undercutter assemblies 19 along the track shoulder. Direction of high pressure hydraulic fluid to the hydraulic motors 22 (not shown) turns the circular undercutters 21 and initiates ballast excavation (FIG. 7). Note that the operator retains precise control over undercutter positioning under diverse ballast bed conditions. Track maintenance may be performed quickly and efficiently regardless of ballast bed depth or track orientation. It will be appreciated that the compactness and simplicity of my design constitutes a great improvement over prior undercutter arrangements.

While I have shown my invention in but one form, it will be obvious to those skilled in the art that it is not so limited, but is susceptible of various changes and modifications without departing from the spirit thereof.

What I claim is:

1. An apparatus for excavating ballast from adjacent the cross tie ends of a railroad track comprising:

(a) a frame supported on said track;

(b) one or more disk-like rotary undercutters suspended from said frame on opposite sides thereof for driven rotation;

(c) means for selectively positioning each of said one or more rotary undercutters for removal of said ballast from adjacent a shoulder or said track inwardly to a point vertically beneath a rail thereof, including: a generally vertical slider box operatively connected to said frame, said vertical slider box being oriented at a small acute angle relative to the vertical centerline of said frame, a vertical column supporting a rotary undercutter and engaged within said vertical slider box and means for moving said vertical column upwardly and downwardly within said vertical slider box.

2. An apparatus as defined in claim 1 wherein said means for selectively positioning further comprises a transverse slider rigidly attached to each vertical slider box, each transverse slider being movable within and supported by a transverse slider box rigidly atop said frame.

3. An apparatus as defined in claim 1 wherein said means for selectively positioning further comprises vertically disposed linear actuators operatively connected to said vertical columns to move said vertical columns within said vertical slider boxes.

4. An apparatus as defined in claim 3 wherein an upper end of said vertically disposed linear actuators is attached to said vertical slider box and a lower end thereof is attached to said vertical column.

5. An apparatus as defined in claim 2 wherein said means for selectively positioning further comprises transversely disposed linear actuators operatively connected to said transverse sliders to move said transverse sliders within said transverse slider boxes.

6. An apparatus as defined in claim 5 wherein one end of each transversely disposed linear actuator is attached to said vertical slider box, the opposite end of each transversely disposed linear actuator being attached to said transverse slider box.

7. An apparatus as defined in claim 1 wherein each rotary undercutter is eccentrically mounted for rotation on the lower end of said vertical column, the plane of rotation of said rotary undercutter being offset below a plane normal to the longitudinal axis thereof; the periphery of said undercutter being coincident with a outside edge of said vertical column and extending inwardly toward said track.

8. An apparatus as defined in claim 7 wherein each undercutter is driven by a hydraulic motor assembly enclosed within said vertical column at the lower end thereof.

9. An apparatus as defined in claim 8 wherein said motor assembly comprises an upper disk-like mounting plate affixed to said vertical column at a lower end thereof, a hydraulic motor with a shaft normal to said upper plate and extending therethrough, a pinion gear attached to said shaft, an annular drive gear engaging said pinion gear, and an annular bearing assembly suspended below said upper plate supporting said annular drive gear.

10. An apparatus as defined in claim 9 wherein a lower disk-like plate is affixed to said annular drive gear for concomitant rotation therewith, said lower plate supporting a cutter bit support ring along the circumference thereof.

11. An apparatus as defined in claim 10 further comprising a plurality of individual cutter bits mounted on the periphery of said cutter bit support ring, said cutter bits projecting alternately above and below the plane of rotation of said undercutter elements.

12. An apparatus as defined in claim 6 wherein said means for selectively positioning further comprises transverse sliders rigidly attached to said vertical slider boxes, said transverse sliders being movable within and supported by a transverse slider box rigidly attached atop said frame.

13. An apparatus for removing ballast from beneath the ends of the crossties of a railroad track said apparatus comprising:

(a) a supporting frame with attached wheels adapted for travel on said track;

(b) horizontally disposed supporting members operatively connected to said frame;

(c) vertically disposed supporting members operatively connected to said horizontally disposed members and suspended on opposite sides of said frame;

(d) disk-like rotary undercutters eccentrically mounted on the lower ends of said vertically disposed supporting members; the periphery of said undercutters being aligned with the outside edge of said vertically disposed supporting members and projecting inwardly therefrom toward said track;

(e) means for vertical movement operatively connected to said vertically disposed supporting members to place said undercutters in a non-working position above said crossties or in a working position adjacent to said crossties; and (f) means for lateral movement operatively connected to said horizontally disposed supporting members to transfer said undercutters from points adjacent a shoulder of said track inwardly to points beneath the rails thereof.

14. An apparatus as defined in claim 13 wherein the plane of rotation of said undercutters lies below a plane normal to the longitudinal axes of said vertically disposed supporting members.

15. An apparatus as defined in claim 14 wherein said undercutters comprise a generally circular upper plate mounted on the lower end of each vertically disposed supporting member; a hydraulic motor mounted atop said upper plate inside said vertically disposed supporting member; an output shaft from said motor extending below said upper plate; a pinion gear affixed to said shaft and engaging the inner face of a ring-like drive gear; an annular bearing assembly suspended from said upper plate for support of said drive gear; and a ring plate affixed to said upper plate to prevent entry of foreign objects into said undercutter.

16. An apparatus as defined in claim 15 wherein said undercutters further comprise a lower plate affixed to said drive gear and rotating concomitantly therewith; a cutter bit support ring engaging the periphery of said lower plate; and a plurality of cutter bits affixed to the periphery of said cutter bit support ring.

17. An apparatus as defined in claim 16 wherein said cutter bits project outwardly from the periphery of said cutter bit support ring to remove ballast from above and below the plane of rotation of said undercutter.

18. An apparatus as defined in claim 17 wherein each vertically disposed supporting member is constrained to move within a vertical slider box; said vertical slider boxes being tilted inwardly toward said track.

19. An apparatus as defined in claim 18 wherein said vertical slider boxes are rigidly affixed to said horizontally disposed supporting members, said horizontally disposed supporting members being constrained to move within horizontal slider boxes rigidly affixed to said frame.

20. An apparatus as defined in claim 19 wherein said means for vertical movement are vertical linear actuators which move said vertically disposed supporting members within said vertical slider boxes.

21. An apparatus as defined in claim 20 wherein said vertical linear actuators have a first point of attachment on the upper ends of said vertical slider boxes and extend longitudinally downward thereform to a second point of attachment on the lower end of an associated vertically disposed supporting member.

22. An apparatus as defined in claim 19 wherein said means for lateral movement are horizontal linear actuators which move said horizontally disposed supporting members within said horizontal slider boxes.

23. An apparatus as defined in claim 22 wherein said horizontal linear actuators have a first point of attachment on an end of said horizontal slider boxes and extend longitudinally alongside said horizontal slider boxes to a second point of attachment on said vertical slider boxes affixed thereto.

* * * * *